US008439600B2

(12) United States Patent
Brening

(10) Patent No.: US 8,439,600 B2
(45) Date of Patent: May 14, 2013

(54) PORTABLE VIBRATORY CONCRETE FLOAT

(76) Inventor: Scott Brening, Loomis, CA (US)

( * ) Notice: Subject to any disclaimer, the term of this patent is extended or adjusted under 35 U.S.C. 154(b) by 0 days.

(21) Appl. No.: 13/351,605

(22) Filed: Jan. 17, 2012

(65) Prior Publication Data

US 2012/0183351 A1 Jul. 19, 2012

Related U.S. Application Data

(60) Provisional application No. 61/433,373, filed on Jan. 17, 2011.

(51) Int. Cl.
*E01C 19/38* (2006.01)

(52) U.S. Cl.
USPC ..... 404/114

(58) Field of Classification Search ..... 404/114, 404/118
See application file for complete search history.

(56) References Cited

U.S. PATENT DOCUMENTS 2,372,163 A * 3/1945 Whiteman ..... 404/119
3,412,658 A * 11/1968 Griffin ..... 404/119
4,359,296 A * 11/1982 Cronkhite ..... 404/114
4,838,730 A * 6/1989 Owens ..... 404/114
5,234,283 A * 8/1993 Adkins ..... 404/97
5,393,168 A * 2/1995 Jarvis ..... 404/97
5,417,517 A * 5/1995 Zollers ..... 404/113
5,540,519 A * 7/1996 Weber ..... 404/102
6,139,217 A * 10/2000 Reuter ..... 404/97
6,923,595 B1 * 8/2005 Chek ..... 404/118
6,981,819 B1 * 1/2006 Suckow et al. ..... 404/114
7,465,121 B1 12/2008 Hendricks et al.
8,075,222 B2 12/2011 Quenzi et al.
2005/0036837 A1 * 2/2005 Marshall ..... 404/114

* cited by examiner

*Primary Examiner* — Gary Hartmann
(74) *Attorney, Agent, or Firm* — Alicia M. Passerin, Esq.; Pietragallo Gordon Alfano Bosick & Raspanti, LLP

(57) ABSTRACT

A vibratory device for use with a concrete finishing tool having a float pad is disclosed. The vibratory device has a mounting plate, a housing attached to the mounting plate, a motor, and a power source. The mounting plate is attached to a top side of the float pad. The housing is attached to said mounting plate. The motor is positioned in the housing and is operatively attached to the mounting plate. The power source is positioned in the housing and is in communication with the motor. Optionally, a counterweight is positioned in the housing and is attached to the motor. The actuation of the motor causes the mounting plate and the float pad to vibrate.

20 Claims, 5 Drawing Sheets

PORTABLE VIBRATORY CONCRETE FLOAT

PRIORITY CLAIM

This application claims priority to U.S. Provisional Application No. 61/433,373, filed on Jan. 17, 2011.

BACKGROUND

Conventional concrete finishing devices are often cumbersome to use because multiple passes across freshly laid wet concrete are required to settle rocks and other aggregate beneath the surface and to bring the cream to the surface in order to achieve a smooth and substantially flat surface. The weight of the concrete finishing device in combination with the need for multiple passes is often physically fatiguing to the operator.

SUMMARY

In an embodiment, a vibratory device for use with a concrete finishing tool having a float pad is disclosed. The vibratory device has a mounting plate, a housing attached to the mounting plate, a motor, and a power source. The mounting plate is attached to a top side of the float pad. The housing is attached to said mounting plate. The motor is positioned in the housing and is operatively attached to the mounting plate. The power source is positioned in the housing and is in communication with the motor. Optionally, a counterweight is positioned in the housing and is attached to the motor. Actuation of the motor causes the mounting plate and the float pad to vibrate.

In another embodiment, a vibratory concrete finishing tool is disclosed. The vibratory concrete finishing tool has a float pad having a substantially flat bottom surface, a handle attached to the float pad, and a vibratory device. The vibratory device includes a mounting plate attached to a top side of the float pad. The vibratory device also has a housing attached to the mounting plate. A motor is positioned in the housing and is operatively attached to the mounting plate. A power source is positioned in the housing and is in communication with the motor. Optionally, a counterweight is positioned in the housing and is attached to the motor. Actuation of the motor causes the mounting plate and the float pad to vibrate.

These and other details, objects, and advantages of the disclosed vibratory device will become better understood or apparent from the following descriptions, examples, and figures showing embodiments thereof.

DETAILED DESCRIPTION

A vibratory device 100 for use with a concrete finishing tool 200 is disclosed, as shown generally in the figures. The vibratory device 100 is configured to cause vibration of the concrete finishing tool 200 in order to settle the aggregate, such as rocks, in wet concrete to below the surface and to bring the cream to the surface. The vibratory device 100 is configured for removable attachment to the concrete finishing tool 200 and may be used with conventional concrete finishing tools 200.

Figure 1:
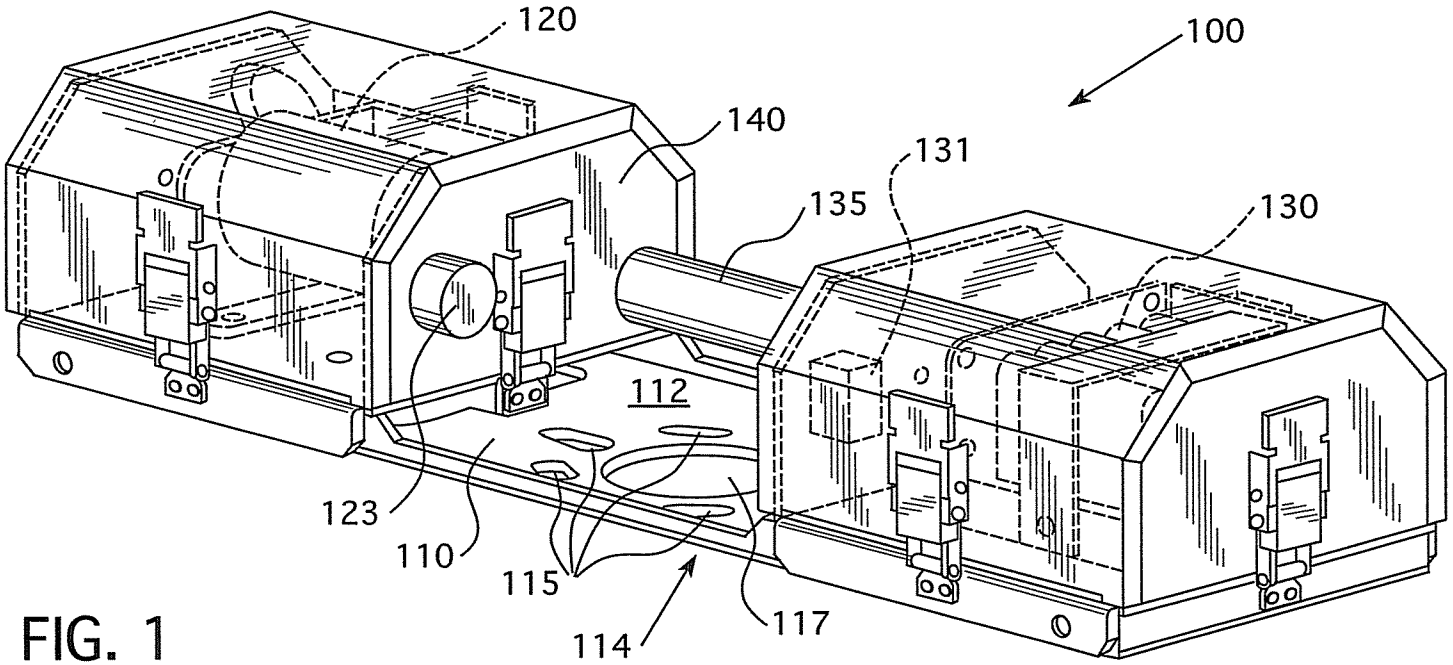
FIG. 1 is a perspective view of an embodiment of the vibratory device.
Figure 2:
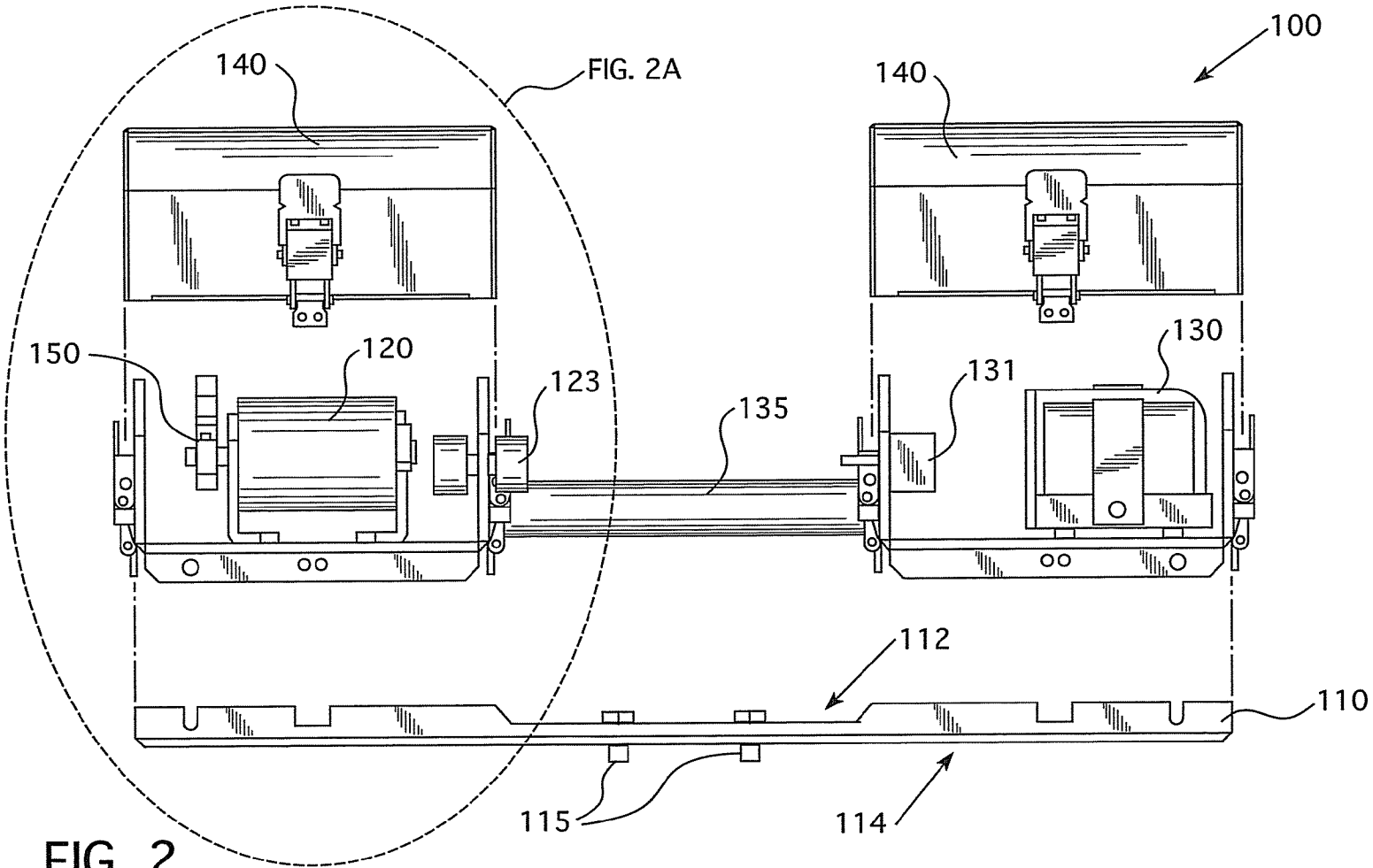
FIG. 2 is a front side view of the embodiment of the vibratory device shown in FIG. 1.
Figure 2A:
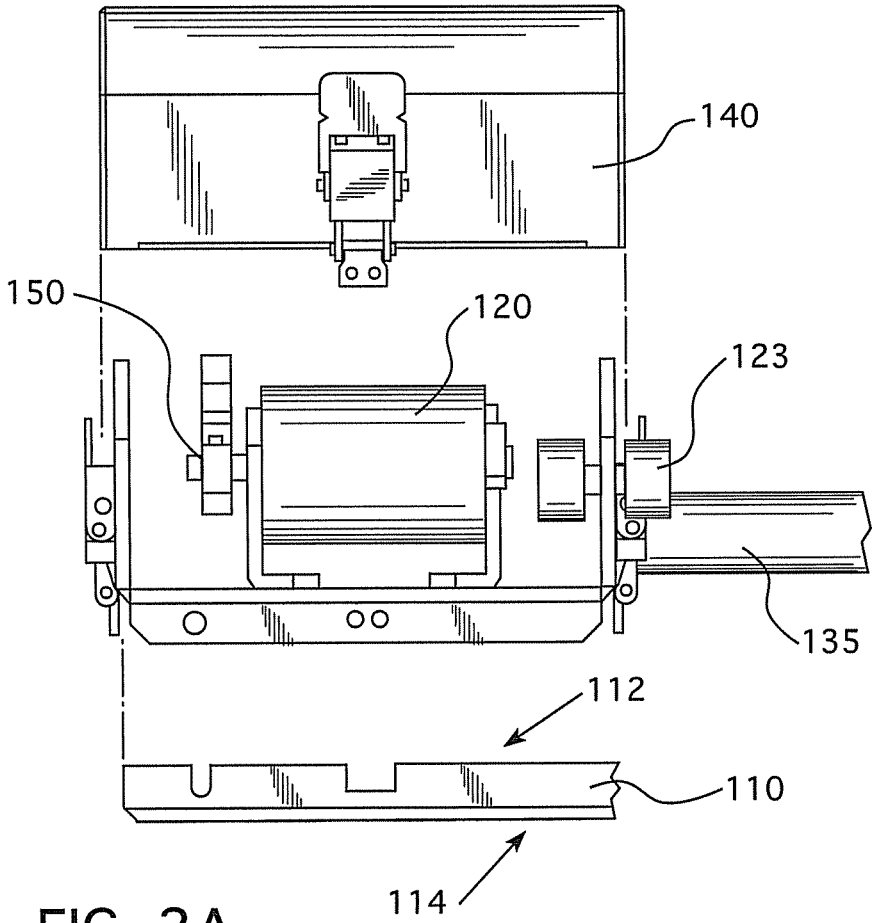
Figure 3:
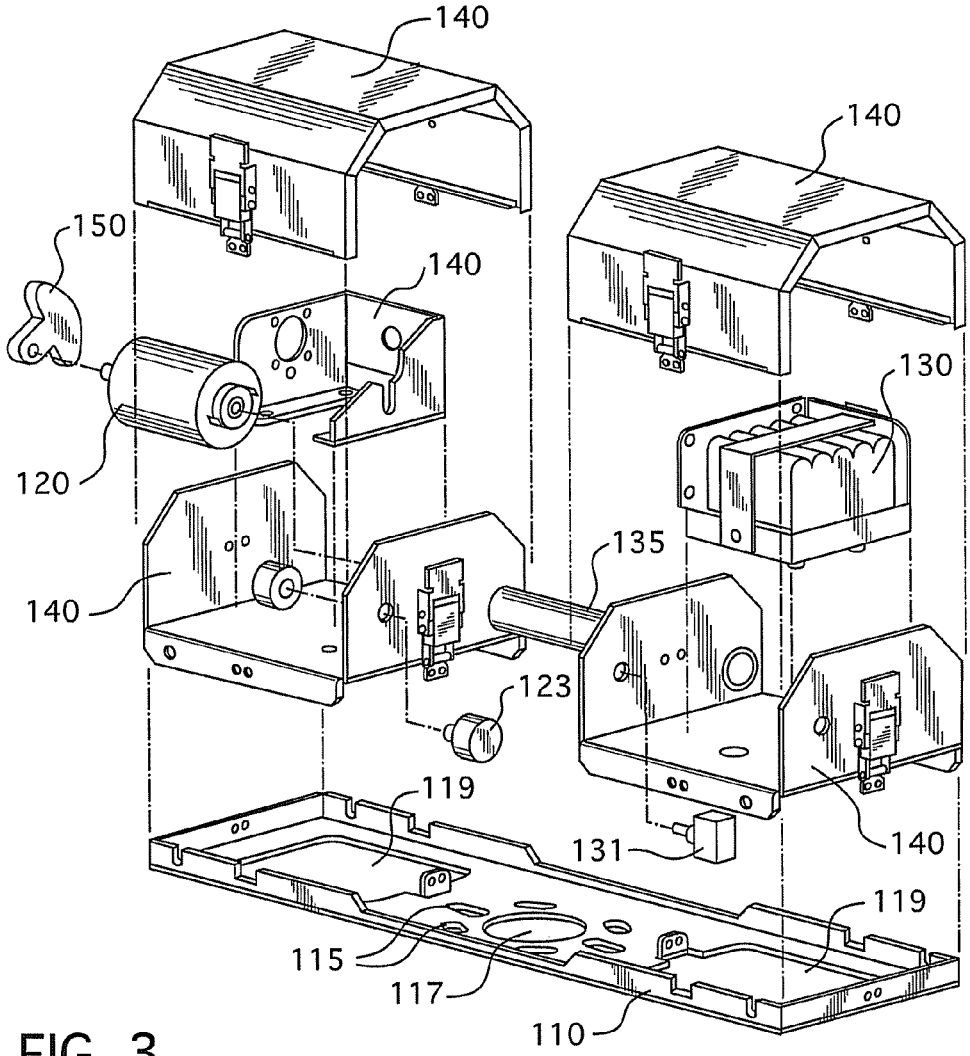
FIG. 3 is an exploded view of the embodiment of the vibratory device shown in FIG. 1.
Figure 4:
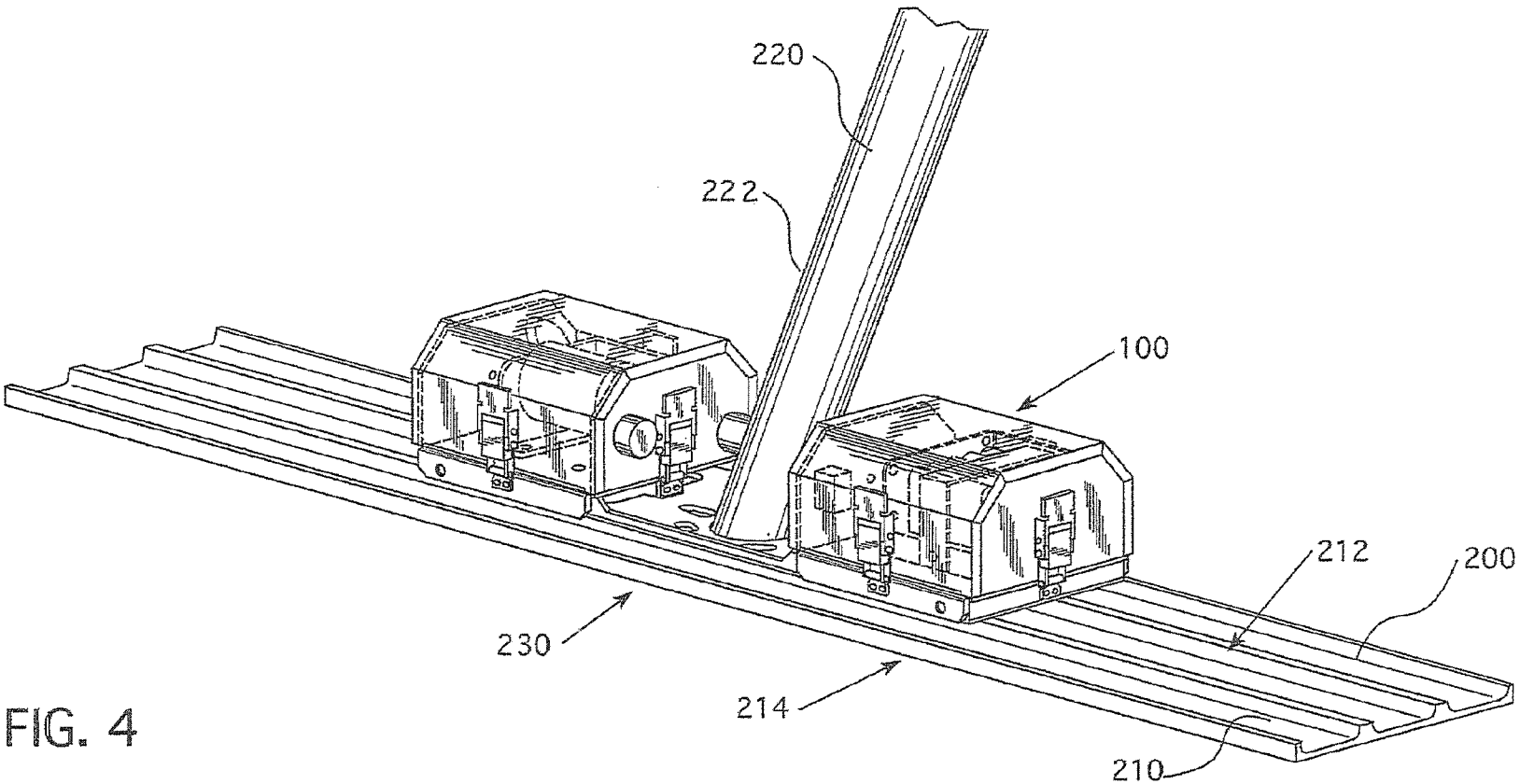
FIG. 4 is a perspective view of the embodiment of the vibratory device shown in FIG. 1 in combination with a concrete finishing tool.

As shown in FIG. 4, the concrete finishing tool 200 includes a float pad 210 having top and bottom surfaces 212, 214, an elongate handle 220, and a handle mount 230 that attaches the handle 220 to the top surface 212 of the float pad 210. Optionally, the handle 220 is angularly pivotal relative to the top surface 212 of the float pad 210. The bottom surface 214 of the float pad 210 is substantially planar and contacts the surface of wet concrete when the concrete finishing tool 200 is in use. The elongate handle 220 has a lower end 222 that is configured for attachment to the handle mount 230. In embodiments, the elongate handle 220 is telescoping. In an embodiment, the handle mount 230 is substantially centered on the top surface 212 of the float pad 210.

As shown in FIGS. 1-4, the vibratory device 100 has a mounting plate 110, a motor 120, and a power source 130. The motor 120 and the power source 130 are housed within a housing 140 that is attached to the top surface 112 of the mounting plate 110. The mounting plate 110 is sized and shaped to be positioned on the top surface 212 of the float pad 210 and has an attaching device 115 for attaching thereto. Attaching device 115 includes bolts, screws, clamps, and the like. The mounting plate 110 includes an opening 117 that is positioned such that the handle mount 230 projects therethrough for attachment of the handle 220 to the float pad 210 when the vibratory device 100 is attached to the float pad 210. In embodiments, the mounting plate 110 is made from aluminum. Optionally, mounting plate 110 includes a plurality of openings 119 in order to reduce the total weight of the vibratory device 100. See FIG. 3.

A motor 120 is operatively attached to the mounting plate 110. The actuation of the motor 120 causes a vibration that is imparted through the mounting plate 110 and is transferred to the float pad 210 to vibrate the stones in wet concrete below the surface and to pull the cream to the top of the surface of the wet concrete. The motor 120 is positioned on the top surface 112 of the mounting plate 110 lateral to the opening for the handle mount 117 and is attached thereto by attaching device, which may include, for example, screws, bolts, and the like. Optionally, the vibratory device 100 has two motors 120 (not shown).

In an embodiment, the motor 120 is compact and lightweight. In an embodiment, the motor weighs about ten pounds. In an embodiment, the motor 120 implements a DC brushless controller and a DC brushless motor. In another embodiment, the motor 120 implements a DC brush motor. In an embodiment, a speed control switch 123 allows the operator to control the amount of vibration that is produced. In embodiments, if the concrete is thick, a higher speed and greater amount of vibration may be preferable to settle the rocks into the concrete. In other embodiments, if the concrete is wet, a slower speed and smaller amount of vibration may be preferable so that the float does not sink into the wet concrete. The speed control switch 123 may be a potentiometer having in an embodiment an external voltage from about 0.5 V to about 5V such that higher speeds impart increased vibration and lower speeds impart less vibration. In embodiments, the motor 120 has a velocity of about 380 rpm to about 4200 rpm. In an embodiment, the motor 120 is attached to a vibratory rotor (not shown) attached to the mounting plate 110 to impart controlled vibration to the float pad 210 to provide a smooth level concrete surface.

A power source 130 is in communication with the motor 120. The power source 130 is operated by a switch 131. As shown in the figures, the power source 130 is attached to the mounting plate 110, is housed in housing 140, and communicates with motor 120 through wiring (not shown) that is contained in a connector tube 135 that connects power source 130 and motor 120. In an embodiment, the power source 130 is a battery pack. In another embodiment, the power source 130 is a rechargeable battery. In another embodiment, the power source 130 is a gas-powered motor. In other embodiments (not shown) the power source 130 is remote from the motor 120, such as being located in a pack that the operator can hold or carry in a back pack or the like.

In an embodiment, the motor 120 and power source 130 are substantially aligned and positioned so that the weight thereof is substantially equally distributed across the float pad 210 in order to keep the bottom surface 214 of the float pad 210 substantially level and to generate a substantially flat and level finished concrete surface.

Optionally, vibratory device 100 includes a counterweight 150. See FIG. 2. Counterweight 150 is positioned on motor 120, such as on the output shaft (not shown) in order to cause a vibration of the motor 120 during operation of the motor 120 that is transferred to the mounting plate 110 and the float pad 210 in use. In embodiments, the counterweight is made from steel.

In another embodiment (not shown), the vibratory device has a mounting plate, a motor, and a power source. The motor and the power source are housed within a housing that is attached to the top surface of the mounting plate. The mounting plate is sized and shaped to be positioned on the handle of the concrete finishing tool and has an attaching device for attaching thereto. Attaching device includes bolts, screws, and the like. In embodiments, the mounting plate is made from aluminum. Optionally, the mounting plate includes a plurality of openings in order to reduce the total weight of the vibratory device.

A motor is operatively attached to the mounting plate. The actuation of the motor causes a vibration that is imparted through the mounting plate and is transferred to the handle down to the float pad to vibrate the stones in wet concrete below the surface and to pull the cream to the top of the surface of the wet concrete. The motor is positioned on the top surface of the mounting plate and is attached thereto by attaching device, including, for example, screws, bolts, and the like. Optionally, the vibratory device has two motors.

In an embodiment, the motor is compact and lightweight and implements a DC brushless controller and DC brushless motor or DC brush motor. In an embodiment, a speed control switch allows the operator to control the amount of vibration that is produced. In an embodiment, the speed control is mounted near first end portion of handle to facilitate access to the speed control by the operator. In another embodiment, the speed control is slidably mounted to the handle. In embodiments, if the concrete is thick, a higher speed and greater amount of vibration is preferable to settle the rocks into the concrete. In other embodiments, if the concrete is wet, a slower speed and smaller amount of vibration is preferable so that the float does not sink into the wet concrete. The speed control switch is a potentiometer having an external voltage from about 0.5 V to about 5V such that higher speeds impart increased vibration and lower speeds impart less vibration. In embodiments, the motor has a velocity of about 380 rpm to about 4200 rpm. In an embodiment, the motor is attached to a vibratory rotor (not shown) attached to the mounting plate to impart controlled vibration to the float pad to provide a smooth level concrete surface.

A power source is in communication with the motor. The power source is operated by a switch. In an embodiment, the power source is attached to the mounting plate and is housed in housing. In an embodiment, the power source is a battery pack, a rechargeable battery, or a gas-powered motor. In other embodiments (not shown) the power source is remote from the motor, such as being located in a pack that the operator can hold or carry in a back pack or the like.

Motor and power source are substantially aligned and positioned so that the weight of the motors is substantially equally distributed along a length of the handle.

Optionally, vibratory device includes a counterweight that is positioned on motor to cause a vibration of the motor during operation of the motor that is transferred to the mounting plate, handle, and the float pad in use.

While the foregoing has been set forth in considerable detail, it is to be understood that the drawings, detailed embodiments, and examples are presented for elucidation and not limitation. Design variations, especially in matters of shape, size, and arrangements of parts, may be made and are within the principles of the invention. Those skilled in the art will realize that such changes or modifications of the invention or combination of elements, variations, equivalents, or improvements therein are still within the scope of the invention as defined in the appended claims.

I claim:

1. A vibratory device for use with a concrete finishing tool having a float pad and a handle attached to a center of the float pad, the vibratory device comprising:

a. a mounting plate configured to be attached to a top side of said float pad, the mounting plate having an opening through which the handle projects;

b. a housing configured to be attached to said mounting plate such that a first portion of the housing is positioned on a first side of the opening and a second portion of the housing is positioned on a second side of the opening opposite the first side;

c. a motor positioned in the first portion of said housing and operatively attached to said mounting plate;

d. a power source positioned in the second portion of said housing and in communication with said motor; and e. a counterweight attached to said motor, wherein actuation of said motor causes said mounting plate and said float pad to vibrate.

2. The vibratory device as in claim 1, wherein the weight of the motor and power source are substantially equally distributed across the float pad.

3. The vibratory device as in claim 1, further comprising a second motor positioned in said housing and operatively attached to said mounting plate.

4. The vibratory device as in claim 1, further comprising a speed control that controls a speed of said motor to control an amount of said vibration caused by said motor.

5. The vibratory device as in claim 1, wherein said power source is a battery pack.

6. The vibratory device as in claim 1, further comprising a connector tube that houses a plurality of wires connecting said power source to said motor by which said power source communicates with said motor.

7. The vibratory device as in claim 4, further comprising a switch that controls operation of said power source.

8. The vibratory device as in claim 4, wherein the speed control comprises a potentiometer for supplying a variable voltage to the motor.

9. The vibratory device as in claim 1, wherein the housing includes a plurality of latches configured for attaching or detaching the first and second portions of the housing to the mounting plate.

10. The vibratory device as in claim 1, wherein the opening is positioned at the center of the mounting plate.

11. A vibratory concrete finishing tool, comprising:

a. a float pad;

b. a handle attached to a center of said float pad; and c. a vibratory device, comprising:

i. a mounting plate configured to be attached to a top side of said float pad, the mounting plate having an opening through which a handle projects;

ii. a housing configured to be attached to said mounting plate such that a first portion of the housing is positioned on a first side of the opening and a second portion of the housing is positioned on a second side of the opening opposite the first side;

iii. a motor positioned in the first portion of said housing and operatively attached to said mounting plate;

iv. a power source positioned in the second portion of said housing and in communication with said motor; and v. a counterweight positioned in said housing and attached to said motor, wherein actuation of said motor causes said mounting plate and said float pad to vibrate.

12. The vibratory device as in claim 11, wherein the weight of the motor and power source are substantially equally distributed across the float pad.

13. The vibratory device as in claim 11, further comprising a second motor positioned in said housing and operatively attached to said mounting plate.

14. The vibratory device as in claim 11, further comprising a speed control that controls a speed of said motor to control an amount of said vibration of said motor.

15. The vibratory device as in claim 11, wherein said power source is a battery pack.

16. The vibratory device as in claim 11, further comprising a connector tube that houses a plurality of wires connecting said power source to said motor by which said power source communicates with said motor.

17. The vibratory device as in claim 11, further comprising a switch that controls operation of said power source.

18. The vibratory device as in claim 14, wherein the speed control comprises a potentiometer for supplying a variable voltage to the motor.

19. The vibratory device as in claim 11, wherein the housing includes a plurality of latches configured for attaching or detaching the first and second portions of the housing to the mounting plate.

20. The vibratory device as in claim 11, wherein the opening is positioned at the center of the mounting plate.

* * * * *